United States Patent [19]

Alloway

[11] 4,428,386

[45] Jan. 31, 1984

[54] SAFETY ASHTRAY

[75] Inventor: Joseph R. Alloway, 11 Great Woods Dr., Trenton, N.J. 08618

[73] Assignees: Joseph R. Alloway; Dominick A. Vizzoni, both of Trenton, N.J.

[21] Appl. No.: 411,143

[22] Filed: Aug. 25, 1982

[51] Int. Cl.[3] ..... A24F 19/00

[52] U.S. Cl. ..... 131/231; 116/67 R

[58] Field of Search ..... 131/235 R, 235 ST, 241, 131/237, 256, 231, 232, 238, 240 R; 296/37.9; 116/67 R, 100, DIG. 1; 232/43.1

[56] References Cited

U.S. PATENT DOCUMENTS

| | | | |
|---|---|---|---|
| 2,752,877 | 7/1956 | Starkenberg | 131/240 E |
| 3,205,900 | 9/1965 | Dahl | 131/240 R |
| 3,360,790 | 12/1967 | Rossitto | 131/231 |
| 4,094,326 | 6/1978 | Newman | 131/234 |
| 4,119,419 | 10/1978 | Passaro et al. | 131/238 |

FOREIGN PATENT DOCUMENTS

| | | | |
|---|---|---|---|
| 7801748 | 9/1979 | Sweden | 131/231 |

*Primary Examiner*—John J. Wilson

*Attorney, Agent, or Firm*—Frederick A. Zoda; John J. Kane

[57] ABSTRACT

A safety ashtray device including a housing having a switch mounted in the upper surface of the housing and secured with respect to the bottom surface of an ashtray device. The ashtray device is movable from an upper switch position to a lower switch position and vice versa. The ashtray device when in the upper switch position closing the contacts in the switch and while in the lower switch position opening the contacts in the switch. A power source is mounted within the housing and is electrically connected in series with respect to the switch contacts as well as a timer and a buzzer. The timer is operable to be set as desired by the operator and the buzzer is adapted to activate responsive to the timer reaching the expired time and the ashtray being in the lower position. In this configuration a series connection will be made between the positive and negative terminals of the power source by a series connection through the switching device and the timer and the buzzer device and returning to the battery. When lighting a cigarette a user will lift the ashtray into the upper position and will set the timer for a predetermined time period after which the buzzer will activate unless the cigarette has been extinguished by pressing downward with the cigarette in the ashtray.

7 Claims, 4 Drawing Figures

SAFETY ASHTRAY

BACKGROUND OF THE INVENTION

1. Field of the Invention

The present invention deals with the field of devices usable for the protection of individuals while smoking in bed or in areas where they are apt to fall asleep with a lit cigarette in their hand. Many devices have been contemplated for preventing loss of life and damage to property due to fires caused by such smoking accidents.

2. Description of the Prior Art

A variety of prior art devices are usable showing ashtray devices which are capable of predetermined operation or are usable to provide alarms for smokers who have fallen asleep. Examples of such patents are shown in U.S. Pat. Nos. 2,752,877; 3,205,900; 3,360,790; 4,094,326; and 4,119,419. Many prior art configurations also include smoke alarms which are adapted to sense extensive smoke and set off an alarm or ionization detectors adapted to sense the carbon products of combustion and also set off an alarm to alert a sleeping smoker.

SUMMARY OF THE INVENTION

The present invention provides a safety ashtray device particularly usable for saving the lives of smokers who fall asleep while actually smoking which includes a housing having a switch means mounted in the upper surface thereof. The switch is movable between an opened contacts position and a closed contacts position. The switch preferably includes a lever extending outwardly therefrom. Preferably the switch is a push-pull switch such that when the lever is in the upper position the contacts of the switch are closed and when the lever is in the lower position the contacts of the switch are opened.

An ashtray is adapted to be connected with respect to the switch and in particular with respect to the lever thereof and is responsive to downward pressure being exerted thereon to urge the switch to the opened contacts position. This results from the downward bias being exerted upon the lever of the switch. Similarly the ashtray is adapted when lifted upwardly to also lift the lever upwardly and thereby urge the switch to the closed contacts position.

A power source such as a 9 volt battery is preferably mounted within the housing and is electrically connected to one side of the contacts of the switch means. The battery preferably includes a first terminal or a positive battery terminal as well as a second terminal or a negative battery terminal. Preferably the positive battery terminal is connected to the switch.

A timer is also preferably mounted within the housing and includes a first connection and a second connection normally in electrical communication with respect to one another. Preferably the first connection is electrically connected to the opposite side of the contacts from the point of connection of the 9 volt power source. The timer preferably includes an actuator such as a dialing knob which is responsive to movement thereof to temporarily interrupt the electrical communication between the first connection and the second connection for a predetermined time period. This dialing knob preferably selects that chosen time period and is operable to hold the circuit open for that time period. Once the time has expired the timer will create an electrical short between the first connection and the second connection allowing a closing of the series circuit of the safety ashtray device of the present invention unless the ashtray has been depressed to the lower position to open the contacts in the switch.

A buzzer is constructed to be operable between an on mode and an off mode wherein the on mode will give a signal. The buzzer means could be a light or a bell whatever means is necessary for indicating. For this reason it could be determined to be an indicator and it includes an A connection and a B connection thereon. This indicator is responsive to electrical signal being passed between the A connection and the B connection to be in the on mode emitting an alarm signal. In this manner the indicator will provide indication of a dangerous condition.

Therefore from the power source the positive terminal thereof will be secured with respect to one side of the contacts of the switch. The other side of the switch will be connected to the first connection of the timer and the second connection of the timer will therefore be secured with respect to the indicator or buzzer means. The buzzer means will then be connected with respect to the negative terminal of the 9 volt battery or power source and thereby complete the series circuit.

It is an object of the present invention to provide an ashtray device with a safety aspect for warning smokers who have fallen asleep while smoking.

It is an object of the present invention to provide a safety ashtray device which is relatively inexpensive.

It is an object of the present invention to provide a safety ashtray device which is easy to maintain with simple household tools.

It is an object of the present invention to provide a safety ashtray devices which includes a timer to allow a smoker to preset over a given range any predetermined time period after which he wishes to be alerted that he has not yet extinguished his cigarette.

It is an object of the present invention to provide a safety ashtray device which utilizes a conventional 9 volt power source.

It is an object of the present invention to provide a safety ashtray device which is extremely easy to preset in order to encourage repeated usage by the owner thereof.

It is an object of the present invention to provide a safety ashtray device which can be used with conventionally configured ashtrays.

It is an object of the present invention to provide a safety ashtray device to remind the smoker that he has not yet extinguished his cigarette.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

The safety ashtray device of the present invention is mounted within a housing 10 which as shown in the figures herein is preferably of a generally rectangular configuration and includes a switch 12 mounted in the upper housing surface 14 thereof. The switch 12 preferably is a conventional push-pull switch 46 movable between an upper position and a lower position. The switch should have a capability of holding in the upper position and holding in the lower position.

Figure 3:
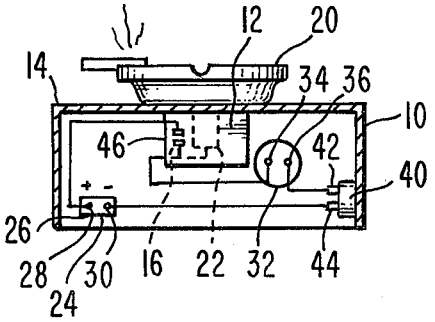
FIG. 3 is a cross section of the configuration shown in FIG. 2 along lines 3—3 showing the ashtray in the down position.
Figure 4:
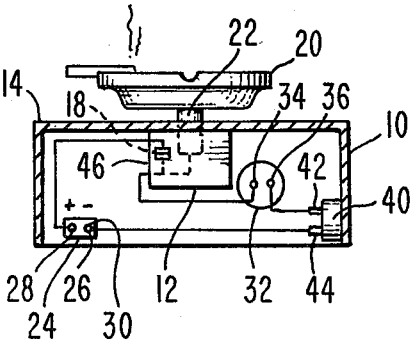
FIG. 4 is an embodiment of the illustration shown in FIG. 3 with the ashtray displayed in the up position.

The ashtray 20 should be secured with respect to the switch 12. For this purpose a lever 22 should be movable within the switch between an upper and a lower position. The lever 22 should be in the integral part of the switch 12 and as such should be capable of movement between the upper position and the lower position. With the ashtray 20 fixedly secured with respect to lever 22 of the switch 12 movement of the ashtray will cause corresponding movement of the switch 12 between the upper and lower positions. When the ashtray is in the upper position as shown in FIG. 4 the contacts of the switch 12 will be in the opened contacts position 16. On the other hand when the ashtray 20 is in the lower position as shown in FIG. 3 the contacts of the switch 12 will be in the closed contacts position 18. Since the present invention makes use of a series connection from one end of the battery to the opposite end of the battery extending through the switch whenever the ashtray 20 is in the upper position with the contacts in the closed position 18 current flow through the switch 12 will be impossible. On the other hand when the ashtray 20 is in the lower position the contacts of the switch 12 will be in the open contacts position 16 to prevent flow of electrical current through the switch 12.

The power source 24 of the present invention is preferably a 9 volt battery 26. Such a power source 24 should include a first terminal 28 which may be the positive battery terminal as well as a second terminal 30 which may be the negative battery terminal.

Figure 1:
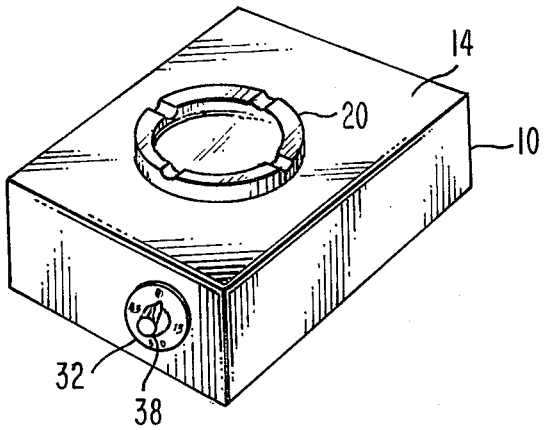
FIG. 1 is a perspective view of an embodiment of the safety ashtray device of the present invention.
Figure 2:
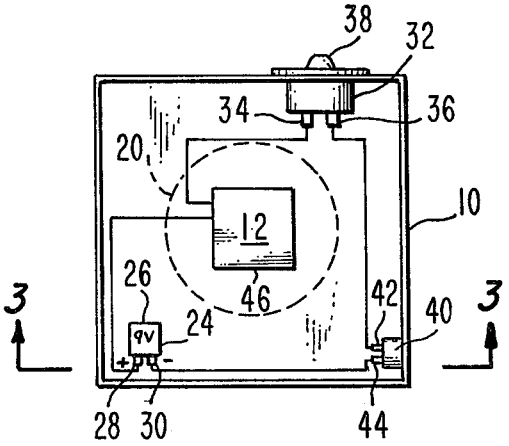
FIG. 2 is a bottom plan view of an embodiment of the safety ashtray device of the present invention.

A timer 32 is preferably mounted within the housing 10 of the present invention and includes an actuator such as a dialing knob 38 thereon for presetting the timer for any predetermined time period within the predesignated time limits. With the configuration shown in FIG. 1 the timer can be set at anywhere between 0 minutes and 60 minutes. Electric communication through the timer between the first connection 34 and the second connection 36 thereof will be interrupted while the timer is still operating. Once the predetermined time period has expired electrical communication between the first connection 34 and the second connection 36 will be possible.

An indicator device such as a buzzer 40 is also included as the alarming device of the present invention. The indicator 40 will include an A connection 42 and a B connection 44 and be operable upon the flow of electrical current between these connections to emit a signal or an alarm such as a buzzer or a light or a bell to provide an alarm to the user.

The devices of the present invention are connected by series lead lines running first from the positive terminal of the battery to one side of the contacts of the switch 12. The opposite side of those contacts will then be connected to the first connection 34 of the timer 32. The second connection 36 of the timer 32 will be connected to the A connection 42 of indicator device 40 and the B connection means 44 thereof will be connected to the second terminal or negative terminal of the 9 volt battery power source. In this manner a single series circuit will extend throughout each of the components of the safety ashtray device of the present invention.

In operation when a user determines that he will smoke a cigarette he will preset the ashtray by lifting it into the upper position and he will set the actuator means or dialing knob 34 to a timer period which he feels will be somewhat greater than the time period necessary for smoking the cigarette or cigar chosen. While the timer is within the predetermined time period it will provide an open circuit between the first connection and the second connection thereof and thereby interrupt actuation of the buzzer device. However if the timer reaches the zero point and the ashtray has not been moved to the down position as shown in FIG. 3 the alarm will be activated to alert the smoker or awaken the smoker. However if the smoker does indeed extinguish the cigarette or cigar in the ashtray prior to termination of the time period set on timer means 32 then the ashtray by the pressure of the extinguishing of the cigarette on the base thereof will be moved downwardly to the opened position shown in FIG. 3. This opened position will provide the contacts of the switch 12 in the opened contacts position 16 and will prevent actuation of the buzzer device 40 upon movement of the actuator 38 of timer 32 to the zero position. At this point the safety ashtray device will be in the position to allow another usage thereof merely by setting of the actuator 38 and movement of the ashtray into the upper position.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A safety ashtray device comprising:

(a) a housing;

(b) a switch mounted in the upper surface of said housing, such switch being movable from an opened contacts position to a closed contacts position and vice versa;

(c) an ashtray connected with respect to said switch and being responsive to downward pressure being exerted thereon to urge said switch to the opened contacts position;

(d) a power source mounted within said housing means and including a first terminal and a second terminal, said first terminal being electrically connected to one side of the contacts of said switch;

(e) a timer mounted within said housing and including a first connection and a second connection normally in electrical communication with respect to one another, said first connection being electrically connected to the other side of the contacts of said power source, said timer including an actuator responsive to activation thereof to temporarily interrupt electrical communication between said first connection and said second connection for a predetermined time period; and (f) an indicator operable between an on mode and an off mode and defining an A connection and a B connection thereon, said indicator responsive to electrical signal being passed between said A connection and said B connection to be in the on mode and provide indication of a dangerous condition, said A connection being in electrical communication with respect to said second connection and said B connection being in electrical communication with respect to said second terminal of said power source.

2. The safety ashtray device as defined in claim 1 wherein said switch comprises a push-pull switch including a lever mounted therein and responsive to being pulled outwardly to place said switch in the closed contacts position and responsive to being pushed inwardly to place said switch in the opened contacts position.

3. The safety ashtray device as defined in claim 1 wherein said power source is a 9 volt battery.

4. The safety ashtray device as defined in claim 3 wherein said first terminal comprises a positive battery terminal and said second terminal means comprises a negative battery terminal.

5. The safety ashtray device as defined in claim 1 wherein said actuator of said timer means comprises a dialing knob movable to choose any desired predetermined time period to maintain interruption between said first connection and said second connection of said timer.

6. The safety ashtray device as defined in claim 1 wherein said indicator comprises a buzzer device.

7. A safety ashtray device comprising:

(a) a housing;

(b) a switch mounted in the upper surface of said housing, said switch being movable from an opened contacts position to a closed contacts position and vice versa, said switch comprising a push-pull switch including a lever mounted therein and responsive to being pulled outwardly to place said switch in the closed contacts position and responsive to being pushed inwardly to place said switch in the opened contacts position;

(c) an ashtray device connected with respect to said lever and being responsive to downward pressure being exerted thereon to urge said switch to the opened contacts position;

(d) a 9 volt battery mounted within said housing and including a positive battery terminal and a negative battery terminal, said positive battery terminal being electrically connected to one side of the contacts of said switch means;

(e) a timer mounted within said housing and including a first connection and a second connection normally in electrical communication with respect to one another, said first connecting being electrically connected to the other side of the contacts of said 9 volt battery, said timer including a dialing knob movable to choose any desired predetermined time period to maintain interruption between said first connection and said second connection of said timer; and (f) a buzzer device operable between an on mode and an off mode and defining an A connection and a B connection thereon, said buzzer device responsive to an electrical signal being passed between said A connection and said B connection to be in the on mode and provide indication of a dangerous condition, said A connection being in electrical communication with respect to said second connection and said B connection being in electrical communication with respect to said negative battery terminal of said 9 volt battery.

* * * * *